United States Patent [19]

Cummins et al.

[11] Patent Number: 4,986,717

[45] Date of Patent: Jan. 22, 1991

[54] DRUM EVACUATOR APPARATUS

[75] Inventors: Samuel P. Cummins, Tinley Park; Theodore M. Yakima, Monee, both of Ill.

[73] Assignee: Algra Inc., Frankfort, Ill.

[21] Appl. No.: 285,127

[22] Filed: Dec. 16, 1988

[51] Int. Cl.[5] ..... B65B 69/00

[52] U.S. Cl. ..... 414/417; 414/421; 222/164; 222/327

[58] Field of Search ..... 414/403, 411, 412, 416, 414/417, 419, 420, 421, 607, 912; 222/164, 327, 386, 389

[56] References Cited

U.S. PATENT DOCUMENTS

| | | | |
|---|---|---|---|
| 1,579,612 | 4/1926 | Hoffman et al. | 414/417 |
| 1,594,200 | 7/1926 | Hill | 222/327 |
| 1,597,950 | 8/1926 | Baynes | 414/417 |
| 2,832,630 | 4/1958 | Sterling | 414/403 X |
| 3,080,078 | 3/1963 | Carew et al. | 414/412 |
| 3,487,965 | 1/1970 | Gale | 414/417 X |
| 3,664,508 | 5/1972 | Linder | 222/386 |
| 3,971,485 | 7/1976 | Hoppey | 414/607 X |
| 4,018,468 | 4/1977 | Lundquist | 414/607 X |
| 4,125,196 | 11/1978 | Liberman et al. | 414/417 X |
| 4,125,197 | 11/1978 | Harvey et al. | 414/417 |
| 4,133,438 | 1/1979 | Liberman et al. | 414/417 |
| 4,326,650 | 4/1982 | Van Manen | 222/386 |
| 4,618,306 | 10/1986 | Dorsch | 414/607 X |

FOREIGN PATENT DOCUMENTS

| | | | |
|---|---|---|---|
| 0013305 | 1/1989 | Japan | 414/417 |
| 0177325 | 2/1966 | U.S.S.R. | 414/417 |
| 0779223 | 11/1980 | U.S.S.R. | 414/417 |

*Primary Examiner*—Frank E. Werner
*Assistant Examiner*—John Vanden Bosche
*Attorney, Agent, or Firm*—Dressler, Goldsmith, Shore, Sutker & Milnamow, Ltd.

[57] ABSTRACT

An apparatus for evacuating viscous or compacted contents from a drum having a cylindrical wall of steel, fiberboard, or other material suitable for such contents and opposite ends, each of which is open except for a movable plunger at one such end serving as the lower end of the drum when the drum is standing on a floor in readiness for the apparatus. The apparatus comprises a support adapted to attach to the fork of a forklift, and a cradle and a pair of hinged closures for securing the drum removably to the cradle. The cradle and hinged closures keyingly engage the drum and are mounted to move the drum between upright and tilted portions. A disc-shaped ramming element fits into and through the cylindrical wall of the drum in the tilted position and forces the contents out of the other end of the drum. A suitable drum is a fiberboard drum with full open ends and with a movable plunger.

18 Claims, 1 Drawing Sheet

DRUM EVACUATOR APPARATUS

TECHNICAL FIELD OF THE INVENTION

This invention pertains to an apparatus for evacuating materials, such as a highly viscous varnishes/polymers for printing inks, or compacted contents, such as compacted pigment "flushings" or paste wax compounds used in printing inks, from a drum having a cylindrical wall and opposite ends, one of which has a movable plunger serving to close that end.

BACKGROUND OF THE INVENTION

Commonly, viscous materials, such as highly viscous varnishes/polymers for printing inks, and compacted materials, such as pigment flushings and paste wax compounds are stored and shipped in standard steel or fiberboard drums from which it is difficult to evacuate such materials.

It has been a known expedient to warm a drum having viscous contents, so as to cause the contents to become less viscous, before attempting to evacuate the contents by dumping or pumping. Also, it has been a known expedient to store and ship viscous materials in drums that have been lined with release-promoting agents, such as silicones or polytetrafluoroethylene, which facilitate dumping of such materials. These and other known expedients, however, have not been entirely satisfactory.

Because residues of such viscous vehicles can present environmental or disposal problems if left in such drums, whether such drums are to be then scrapped or reconditioned, and because such viscous vehicles can be quite expensive, it is important for users to evacuate as much as can be practically evacuated from such drums. Thus, it has been a practical necessity, heretofore, for users to resort to manual scraping and similar efforts to remove residues of such viscous materials from the bottom and cylindrical interior walls of such drums. Typically, and undesirably, users have to reach deeply into such drums in order to remove such residues.

Accordingly, there has been a need, to which this invention is addressed, for a better system for evacuating such viscous or compacted contents from a drum having a cylindrical wall of steel, fiberboard, or other material.

SUMMARY OF THE INVENTION

This invention provides an apparatus for evacuating viscous or compacted contents from a drum having an exterior surface including a cylindrical wall of steel, fiberboard, or other material and opposite ends. One such end is closed by a closure comprising a movable plunger. The other end is open and serves as a discharge end. The apparatus does not necessarily require the drum and its contents to be pre-warmed and eliminates any need for manual scraping or similar efforts to remove residue of the contents from deep portions of the drum.

The end of the drum with the movable plunger can serve as the lower or base end of the drum when the drum is standing on a floor in readiness for the apparatus noted above. Thus, the plunger prevents any of the contents from dropping through such end when the drum is standing on such end, and when the drum is tilted by such apparatus in a manner to be later described. For shipping and storage purposes, the drum may be also provided with a removable cover of a standard type for the other, open, discharge end, or for each end, but each such cover is removed before such apparatus is used to evacuate the contents from the drum. The drum may be also provided with rims of a first shape at the ends of the drum. The first shape may extend inwardly or outwardly, preferably inwardly, and defines a locking formation, which may cooperate with clamping means of the apparatus noted above.

Broadly, this invention provides an apparatus comprising a support and several means mounted on the support, namely, movable clamping means for releasably gripping the exterior wall of the drum, tilting means for tilting the drum relative to the support between an upright position and a tilted position, and driving means for engaging the movable plunger and for driving the movable plunger from one end of the drum toward the other end of the drum to force the contents from the drum while the drum is in the tilted position. In the tilted position of the drum, the drum may be horizontally disposed.

In a preferred form, the clamping means comprises a cradle, which is mounted pivotally to the support for pivotal movement of the cr to the support about a horizontal axis and which is adapted to fit along and around a portion of the cylindrical wall of the drum, preferably along nearly the entire length of such wall and around approximately one half of such wall.

In the preferred form of the clamping means, means are provided for securing the drum removably to the cradle so that the drum is supported by the cradle when the drum is in the tilted position. Also, if the drum is provided with rims of a first shape as noted above, the clamping means may include portions of a matching second shape. Thus, when the clamping means grips the exterior surface of the drum, the matching second shape engage the first shape, so as to provide against axial movement of the drum relative to the clamping means. Such engagement may be described as a keying engagement.

In a preferred form, which may be advantageously used with the preferred form of the clamping means, the tilting means is operative for tilting the cradle so as to tilt the drum between the upright position and the tilted position. Thus, the tilting means may comprise, preferably on each side of the cradle, a crank arm connected to the cradle for pivotal movement with the cradle and a piston-cylinder mechanism having a piston end and a cylinder end. Each piston-cylinder mechanism of the tilting means may be hydraulically actuated.

In the preferred form of the tilting means, one such end of each piston-cylinder mechanism noted above, preferably its cylinder end, is connected pivotally to the support, and the other end of each piston-cylinder mechanism noted above, preferably its piston end, is connected pivotally to the crank arm associated therewith. Preferably, the axis of pivotal movement of the piston end of such a piston-cylinder mechanism on a given side of the cradle coincides with the axis of pivotal movement of the piston end of such a piston-cylinder mechanism on the other side of the cradle, and the axes of pivotal movement of the cylinder ends of the same mechanisms coincide as well.

In the preferred form of the tilting means, the piston-cylinder mechanisms of the tilting means are adapted to be forward-actuated, so as to pivot the crank arms and the cradle in a given rotational sense, whereby the drum is tilted from the upright position to the tilted position, and to be reverse-actuated, so as to pivot the crank arms and the cradle in the opposite rotational sense, whereby the drum is tilted from the tilted position to the upright position.

In a preferred form, the driving means comprises a piston-cylinder mechanism having a piston end and a cylinder end. Such mechanism, which may be hydraulically actuated, is adapted to be forward-actuated and reverse-actuated. The cylinder end of such mechanism is mounted rigidly to the support. The piston end of such mechanism is provided with a ramming element, which may be disc-shaped, and which is adapted to fit through the end of the drum with the plunger and which is adapted to move parallel to the cylindrical wall of the drum so as to extrude the contents of the drum through the other end of the drum when such mechanism is forward-actuated, and so as to withdraw from the drum when such mechanism is reverse-actuated. When the plunger is frangibly secured to the drum, the ramming element tears the plunger away for movement along the inside wall of the drum.

The support may be advantageously configured to receive a forklift fork. Thus, the apparatus may be easily maneuvered by means of a forklift, e.g., so as to approach a drum standing on a floor, so that the clamping means can be clamped onto the drum, to lift the apparatus, so that the clamping means and the drum are lifted, and to position the drum relative to a receptacle for the contents of the drum, before tilting the drum and extruding the contents of the drum into the receptacle.

This invention also provides a novel drum for use with the apparatus described above. The drum has a cylindrical main body having a cylindrical inner wall surface along its length. The main body defines a base end and an open discharge end. An annular rim surrounds the exterior surface of the main body at each end of the main body. Each such rim defines a locking formation, preferably a concave recess.

A movable plunger is disposed within the base end of the main body and is movable while in engagement with the cylindrical inner wall surface from the base end along the length of the main body to the open discharge end. The plunger has a shape substantially identical to the cross-sectional shape of the cylindrical inner wall surface. The open discharge end defines an opening of a size and shape substantially the same as the size and cross-sectional shape of the cylindrical inner wall surface.

Means may be also provided at the open end of the drum for restraining movement of the plunger outwardly of the open end of the drum.

These and other objects, features, and advantages of this invention will be evident from the following description of a preferred embodiment of this invention with reference to the accompanying drawings.

DETAILED DESCRIPTION OF THE PREFERRED EMBODIMENTS

Figure 1:
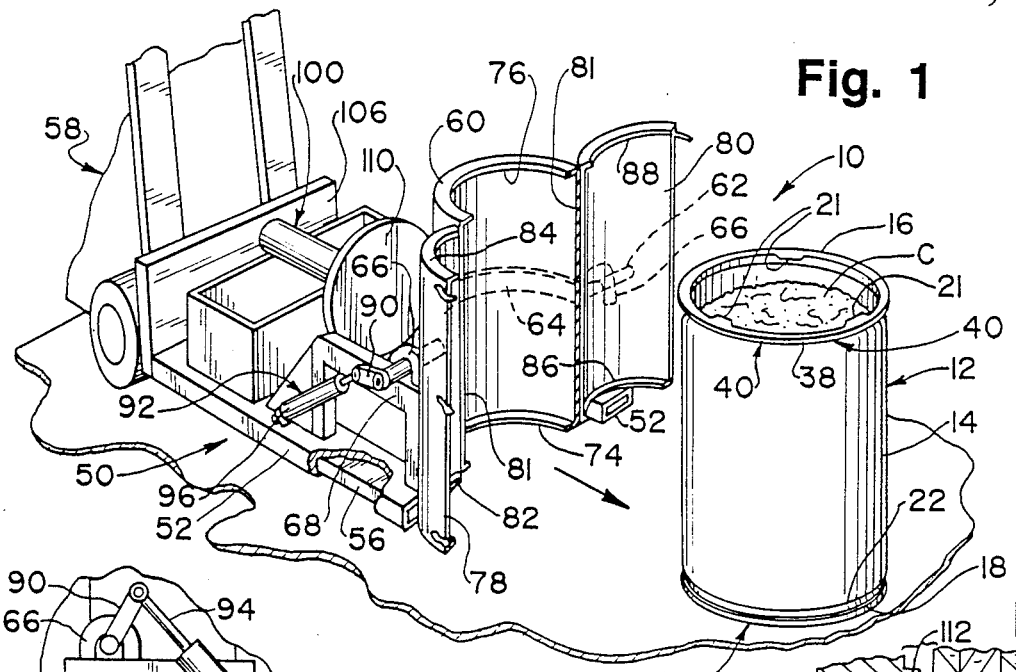
FIG. 1 is a fragmentary, perspective view of an apparatus constituting a preferred embodiment of this invention, as shown as fitted onto a forklift being used to move the apparatus toward a drum containing viscous or compacted contents.

As shown in the drawings, an apparatus 10 for evacuating viscous or compacted contents C, such as a highly viscous vehicle for printing inks, from a drum 12 constitutes a preferred embodiment of this invention.

The drum 12 has an exterior surface including a cylindrical wall 14 of fiberboard and has opposite ends 16, 18, which are open except for a closure 20 (FIG. 5) at the end 18. The cylindrical wall 14 may but does not have to be lined with a release-promoting agent, such as a silicone or polytetrafluoroethylene, in accordance with known practices. As shown in FIG. 1, the end 18 having the closure 20 is intended to serve as the lower or base end of the drum 12 when the drum 12 is standing on a floor, so that the closure 20 prevents any of the contents C from dropping through the end 18 as the drum 12 is being tilted by the apparatus 10 in a manner to be later described. The other end 16 is open and serves as a discharge end. End 16 defines an opening of a size and shape substantially the same as the size and cross-sectional shape of the cylindrical inner wall surface of the cylindrical wall 14.

For shipping and storage purposes, the drum 12 may be also provided with a removable cover (not shown) of a standard type for the other end 16, or for each end, but each such cover is removed before the apparatus 10 is used to evacuate the contents C of the drum 12.

Figure 4:
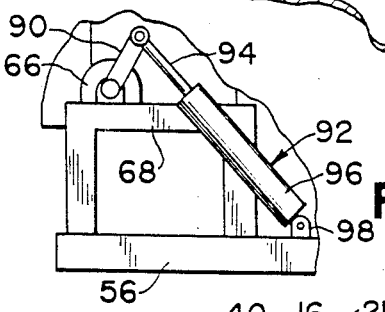
FIG. 4 is a fragmentary, elevational view taken from the other side of the apparatus as shown in FIG. 3.

As shown in FIG. 4, the end 18 having the closure 20 is provided with a steel chime or rim 22, which is rolled, together with adjacent portions of the cylindrical wall 14, so as to provide a concave, inwardly facing, annular formation 24 near the end 18, and so as to mount an inwardly facing, annular rim 26 of fiberboard to the end 18.

A plunger 37 including a disc 28 of fiberboard is frangibly secured via adhesive to the annular rim 26 so as to lie above the annular rim 26 when the drum 12 is standing on the other end 18. A disc-shaped insulator 30 of rigid, foamed, polymeric material, such as polystyrene foam or polyurethane foam, is disposed against the disc 28 so as to lie above the disc 28 when the drum 12 is standing on such end 18. A disc 32 of fiberboard is disposed against the insulator 30. A circular sheet 34 of synthetic rubber or other flexible material covers one face of the disc 32 so as to lie above the disc 32. The circular sheet 34 extends radically beyond the disc 32 so as to form a flexible lip 36 disposed to wipe the inside of the cylindrical wall 14 of the drum 12.

Collectively, the disc 28, the insulator 30, the disc 32, and the circular sheet 34 constitute a plunger 37, which can move from the end 18 of the drum 12 toward the end 16 of the drum 12. The plunger 37 has a shape substantially identical to the cross-sectional shape of the cylindrical inner wall surface of the cylindrical wall 14 of the drum 12.

As shown in FIG. 1, the other end 16 of the drum 12 is provided with a steel crime or rim 38, which is rolled, together with adjacent portions of the cylindrical wall 14, so as to provide a concave, inwardly facing, annular formation 40 near the end 16. The annular formation 40 is similar to and spaced axially from the annular formation 24. End 16 may be provided with restraining means, such as tabs 21. Tabs 21 may be formed with the rim 38.

Broadly, the apparatus 10 comprises a support sledge 50, which can stand on a floor, and which serves as a support for the clamping, tilting, and extruding means which are mounted on the sledge 50. As shown, the sledge 50 comprises a pair of closed, rectangular channels 52, which are adapted to matingly receive a fork 56 of a forklift 58. Thus, the apparatus 10 may be easily lifted, moved, along the floor, and otherwise maneuvered by means of the forklift 58, e.g., so as to approach a drum 12 standing on a floor (see FIG. 1) or in a raised platform (not shown) so that clamping means discussed below can be clamped onto the drum 12, and to lift the apparatus 10 so that the clamping means and the drum 12 are lifted, as well as to position the drum 12 relative to a receptacle 59 (see FIG. 3) for its contents C, before tilting the drum 12 and forcing the contents of the drum 12 out into the receptacle 59.

The clamping means of the apparatus 10 is designed for releasably gripping the exterior surface of the drum 12 and comprises a semi-cylindrical cradle 60, which is mounted pivotally on the sledge 50 for pivotal movement relative to the sledge 50 about a horizontal axis. The cradle 60 is mounted pivotally on the sledge 50 by means of a pair of pivot pins 62, which extend rigidly and respectively from opposite sides of a reinforcing bracket 64 through respective ones of a pair of journals 66. The reinforcing bracket 64 embraces and is mounted integrally to the outside of the cradle 60. The journals 66 are mounted rigidly on respective ones of a pair of upright bolsters 68, which are mounted rigidly and respectively on the rectangular channels 52. The pivot pins 62 and the journals 66 define the aforementioned axis of pivotal movement of the cradle 60 relative to the sledge 50.

The cradle 60 is adapted to fit along nearly the entire length of the cylindrical wall 14 of the drum, between the annular formation 24 and the annular formation 40, and to fit around approximately one half of such wall 14. As shown, the cradle 60 is provided with an inwardly facing, annular rib 74, which fits into and keyingly cooperates with the annular formation 22, and with a similar rib 76, which is spaced axially from the annular rib 74, and which fits into and cooperates with the annular formation 38, in what may be described as a keying engagement, so as to restrain against axial movement of the drum 12 relative to the cradle 60 when the cylindrical wall 14 is clamped to the cradle 60.

Figure 2:
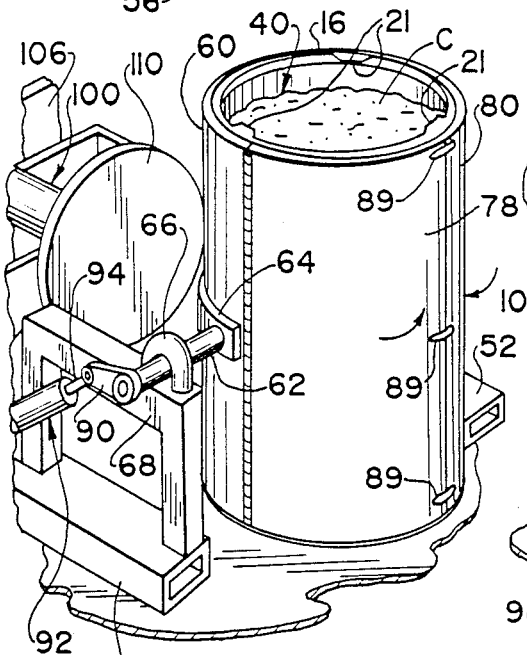
FIG. 2 is a somewhat enlarged, fragmentary, perspective view of the apparatus, as shown after the drum has been clamped but before the drum is tilted from an upright position.

The clamping means of the apparatus 10 also comprises a pair of quarter-cylindrical, hinged closures 78, 80, which are hinged respectively to the cradle 60 by vertical hinges 81, which are adapted to fit along and around respective portions of the cylindrical wall 14 of the drum 12, and which can be manually closed over the drum 12 and latched to each other, as shown in FIG. 2, so as to secure the drum 12 releasably to the cradle 60. When the hinged closures 78, 80, are closed, the cradle 60 and the hinged closures 78, 80, embracingly encircle the cylindrical wall 14 of the drum 12.

The hinged closure 78 has an inwardly facing, annular rib 82, which fits into and cooperates with the annular formation 24, and a similar rib 84, which is spaced axially from the annular rib 82 by a distance equal to the axial distance between the annular formation 40 and the annular formation 24, and which fits into and cooperates with the annular formation 40, in a keying engagement, so as to restrain against axial movement of the drum 12 relative to the hinged closure 78 when the cylindrical wall 14 is clamped to the cradle 60.

The hinged closure 80 has a similar rib 86, which fits into and cooperates with the annular formation 24, and a similar rib 88, which is spaced axially from the annular rib 86 by the distance noted above, and which fits into and cooperates with the annular formation 40 in a keying engagement like the keying engagement described above, so as to restrain axial movement of the drum relative to the hinged closure 80 when the cylindrical wall 14 is clamped to the cradle 60.

Three sets of manual latches 89 are provided for latching the hinged closures 78, 80, to each other, thereby to maintain the cradle 60 and the closures 78, 80 in their embracing relationship to the drum 12.

The tilting means of the apparatus 10 is operative for tilting the cradle 60 so as to tilt the drum 12 (while the cylindrical wall 14 of the drum 12 is gripped by the clamping means described above) between the upright position (see FIGS. 1 and 2) and the tilted position (see FIG. 3) wherein the drum 12 is disposed horizontally.

The tilting means of the apparatus 10 comprises, on each side of the cradle 60, a crank arm 90 mounted to the cradle 60 via the pivot pins 62 and the reinforcing bracket 64 for pivotal movement with the cradle 60, and a piston-cylinder mechanism 92 having a piston end 94 and a cylinder end 96. Each crank arm 90 is connected rigidly to one of the pivot pins 62. Each piston-cylinder mechanism 92 is arranged to be hydraulically actuated.

The cylinder end 96 of each piston-cylinder mechanism 92 is connected pivotally to the sledge 50, via a pivot block 98, for pivotal movement relative to the sledge 50 about an axis parallel to the axis of pivotal movement of the cradle 60 relative to the sledge 50. The piston end 94 of each piston-cylinder mechanism 92 is connected pivotally to the crank arm 90 associated therewith for pivotal movement relative to the crank arm 90 associated therewith about an axis parallel to the axis of pivotal movement of the cradle 60 relative to the sledge 50. Moreover, the axes of pivotal movement of the piston ends 94 of both piston-cylinder mechanisms 92 coincide, and the axes of pivotal movement of the cylinder ends 96 of such mechanisms 92 coincide. Such mechanisms 92, which are adapted to be forward-actuated and reverse-actuated, are connected to hydraulic circuits (not shown) of the apparatus 10 so as to be forwarded-actuated or reverse-actuated in conjunction with each other.

Figure 3:
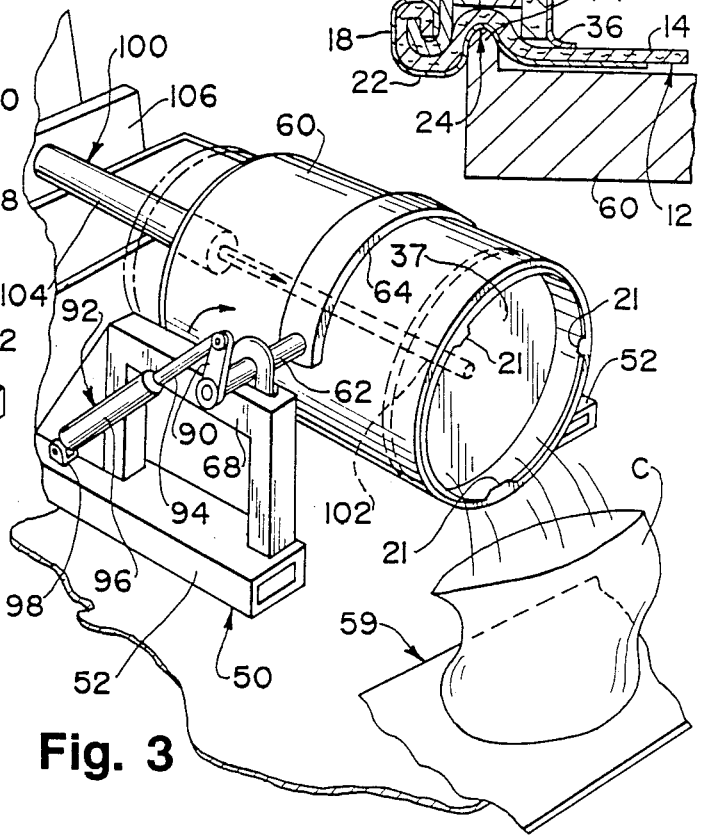
FIG. 3 is a similarly enlarged, fragmentary, perspective view of the apparatus, as shown after the drum has been tilted into a tilted position and all or substantially all of the contents of the drum have been evacuated.

When the piston-cylinder mechanisms 92 are forward-actuated, the crank arms 90, the pivot pins 62, the reinforcing bracket 64, and the cradle 60 are pivoted conjointly in a pivotal sense indicated by a curved arrow in FIG. 3, so as to tilt the clamped drum 12 into the tilted horizontal position. When such mechanisms 92 are reverse-actuated, the crank arms 90, the pivot pins 62, the reinforcing bracket 64, and the cradle 60 are pivoted conjointly in an opposite pivotal sense, so as to tilt the clamped drum 12 into the upright vertical position.

The cradle 60 and the drum 12 must be aligned before the cradle 60 can be clamped onto the drum 12. Thus, it is necessary to elevate the apparatus 10 to suitably align the cradle and drum, as by means of the forklift 58.

Before tilting the cradle 60 so as to tilt the drum 12, in order to avoid interference with the floor, the sledge 50 must be suitably elevated.

The driving means of the apparatus 10 comprises a piston-cylinder mechanism 100 having a piston end 102 and a cylinder end 104. Mechanism 100, which is arranged to be hydraulically actuated, is connected to hydraulic circuits (not shown) of the apparatus 10 and is adapted to be forward-actuated and reverse-actuated. The cylinder end 104 of such mechanism 100 is mounted rigidly to an upright wall 106 of the sledge 50.

The piston end 102 of such mechanism 100 is provided with a ramming element 110, which is disc-shaped, as shown, and which is adapted to pass through the end 18 of the clamped drum 12 to engage the plunger 37, to tear the plunger from the rim 26, and to move along the cylindrical wall 14 of the drum 12 so as to drive the contents C of the clamped drum 12 through the discharge end 16 of the drum 12 when mechanism 100 is forward-actuated, and so as to withdraw from the clamped drum 12 when mechanism 100 is reverse-actuated.

Figure 5:
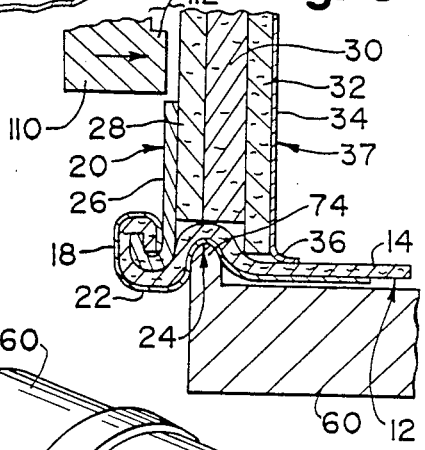
FIG. 5 is a greatly enlarged, sectional view taken along a central axis of the drum after the drum has been tilted and before any substantial part of the contents of the drum has been evacuated. The contents of the drum are not shown in FIG. 5.

As shown in FIG. 5, the ramming element 110 has an axially projecting, annular rim 112, which helps to tear the plunger 37 away from from the annular rim 26. When most or all of the contents C of the clamped drum 12 have been extruded through the end 16 of the drum 12, the tabs 21 at the discharge end 16 of the drum 12 restrain the plunger 37 from falling through the open end 16 of the clamped drum 12.

As the plunger 37 and associated circular sheet 34 move along the cylindrical wall 14 of the clamped drum 12, the flexible lip 36 wipes the inner wall surface, whereby little if any residue of the contents C is left on that surface. Any residue near the open end 16 of the drum 12 may be easily scraped away or otherwise removed by a user attending the apparatus 10 (who does not have to reach deeply into the drum 12), and before or after the drum 12 is tilted to its upright position, unclamped, and removed for scrapping or reconditioning.

It will be apparent to those skilled in the art that numerous changes can be made in the apparatus described above without departing from the scope and spirit of this invention. Usage of such an apparatus is not limited to evacuating viscous or compacted contents pertaining to printing inks. Other materials can be effectively evacuated by means of such an apparatus.

We claim:

1. Apparatus for evacuating viscous or compacted contents from a drum having an exterior surface including a cylindrical wall and having opposite ends, one of which is closed by a closure comprising a movable plunger and the other of which is open, the apparatus comprising:

(a) a support;

(b) movable clamping means mounted on the support for releasably gripping the exterior surface of the drum;

(c) tilting means mounted on the support for tilting the drum relative to the support between an upright position wherein the drum is upright and a substantially horizontal position wherein the drum is substantially horizontal; and (d) driving means mounted on the support for engaging the movable plunger and for driving the movable plunger in a substantially horizontal direction, from one end of the drum toward the other end of the drum, to force the contents of the drum from said other end of the drum while the drum is in the substantially horizontal position.

2. The apparatus of claim 1 wherein the exterior surface of the drum defines rims of a first shape at the ends of the drum, wherein the movable clamping means includes portions of a matching second shape, and wherein, when the movable clamping means grips the exterior surface of the drum, the matching second shape engages the first shape.

3. The apparatus of claim 1 wherein the movable clamping means comprises a cradle mounted pivotally on the support for pivotal movement of the cradle relative to the support about a horizontal axis, the cradle being adapted to fit along and around a portion of the cylindrical wall of the drum, and means for securing the drum removably to the cradle so that the drum is supported by the cradle when the drum is in the substantially horizontal position.

4. The apparatus of claim 3 wherein the tilting means is operative for tilting the cradle so as to tilt the drum between the upright position and the substantially horizontal position.

5. The apparatus of claim 4 wherein the tilting means comprises a crank arm connected to the cradle for pivotal movement with the cradle and a piston-cylinder mechanism having a piston end and a cylinder end, one such end of the piston-cylinder mechanism being connected pivotally to the support and the other end of the piston-cylinder mechanism being connected pivotally to the crank arm.

6. The apparatus of claim 5 wherein the piston-cylinder mechanism is hydraulically actuated.

7. The apparatus of claim 4 wherein the tilting means comprises, on each side of the cradle, a crank arm connected to the cradle for pivotal movement with the cradle and a piston-cylinder mechanism having a piston end and a cylinder end, one such end of the piston-cylinder mechanism on each side of the cradle being connected pivotally to the support and the other end of the piston-cylinder mechanism on each side of the cradle being connected pivotally to the crank arm on the same side of the cradle for pivotal movement relative to the crank arm such side of the cradle.

8. The apparatus of claim 7 wherein the axis of pivotal movement of the piston end of the piston-cylinder mechanism on a given side of the cradle coincides with the axis of pivotal movement of the piston end of the piston-cylinder mechanism on the other side of the cradle and wherein the axis of pivotal movement of the cylinder end of the piston-cylinder mechanism on the given side of the cradle coincides with the axis of pivotal movement of the cylinder end of the piston-cylinder mechanism on the other side of the cradle.

9. The apparatus of claim 8 wherein each piston-cylinder mechanism is hydraulically actuated.

10. The apparatus of claim 3 wherein the driving means comprises a piston-cylinder mechanism having a piston end and a cylinder end and being adapted to be forward-actuated and reverse-actuated, the cylinder end of the piston-cylinder mechanism of the extruding means being mounted on the support, the piston end of the piston-cylinder mechanism of the driving means being provided with a ramming element which is adapted to pass through said one end of the drum and move parallel to the cylindrical wall of the drum to force the contents of the drum through said other end of the drum when the piston-cylinder mechanism of the driving means is forward-actuated, and to withdraw from the drum when the piston-cylinder mechanism of the driving means is reverse-actuated.

11. The apparatus of claim 10 wherein the piston-cylinder mechanism of the driving means is hydraulically actuated.

12. The apparatus of claim 11 wherein the cylinder end of the piston-cylinder mechanism of the driving means is mounted rigidly to the support.

13. The apparatus of claim 10 wherein the ramming element is disc-shaped.

14. The apparatus of claim 13 wherein the piston-cylinder mechanism of the driving means is hydraulically actuated.

15. The apparatus of claim 1 wherein the support is configured to matingly receive a forklift fork.

16. Apparatus comprising a generally cylindrical drum, a support securing the drum thereto, the drum having an exterior wall of a cylindrical shape and a plunger movable through the drum from one end of the drum toward the other end of the drum, the support including means movable thereon for embracing said exterior wall and for keyingly engaging said exterior wall to prevent movement of said drum relative to said support, means pivotally mounting said movable means on said support for movement of said drum between a vertical position and a horizontal position, and driving means on said support aligned with said plunger when said drum is in a horizontal position for moving said plunger in a horizontal direction through said drum.

17. The apparatus of claim 16 wherein said exterior wall defines at least one concave recess and the movable means includes means for keyingly engaging in said concave recess when the movable means embraces the exterior wall.

18. The apparatus of claim 17 wherein said exterior wall includes a rim defining said concave recess.

* * * * *